US008685350B2

(12) United States Patent
Okamoto et al.

(10) Patent No.: US 8,685,350 B2
(45) Date of Patent: Apr. 1, 2014

(54) METHOD FOR SEPARATING ARSENIC MINERAL FROM COPPER-BEARING MATERIAL WITH HIGH ARSENIC GRADE

(75) Inventors: Hideyuki Okamoto, Niihama (JP); Yoshiyuki Tanaka, Niihama (JP); Tsuyoshi Hirajima, Fukuoka (JP); Keiko Sasaki, Fukuoka (JP)

(73) Assignees: Sumitomo Metal Mining Co., Ltd., Tokyo (JP); Kyushu University, National University Corporation, Fukuoka-Shi (JP)

( * ) Notice: Subject to any disclaimer, the term of this patent is extended or adjusted under 35 U.S.C. 154(b) by 0 days.

(21) Appl. No.: 13/577,353

(22) PCT Filed: Feb. 3, 2011

(86) PCT No.: PCT/JP2011/052251

§ 371 (c)(1), (2), (4) Date: Sep. 14, 2012

(87) PCT Pub. No.: WO2011/096479

PCT Pub. Date: Aug. 11, 2011

(65) Prior Publication Data

US 2013/0004389 A1 Jan. 3, 2013

(30) Foreign Application Priority Data

Feb. 4, 2010 (JP) ..... 2010-022906

(51) Int. Cl.
*B03D 1/01* (2006.01)

(52) U.S. Cl.
USPC ..... 423/26; 423/87; 209/166; 209/167

(58) Field of Classification Search
USPC ..... 423/26, 87; 209/166, 167
See application file for complete search history.

(56) References Cited

U.S. PATENT DOCUMENTS 5,171,428 A 12/1992 Beattie et al.
7,004,326 B1 * 2/2006 Dai et al. ..... 209/166

(Continued)

FOREIGN PATENT DOCUMENTS

JP 2006-239553 A 9/2006

OTHER PUBLICATIONS

D. Fornasiero et al., "Separation of enargite and tennantite from non-arsenic copper sulfide minerals by selective oxidation or dissolution," Int. J. Mineral Processing, 61, 2001, pp. 109-119.

(Continued)

*Primary Examiner* — Steven Bos
(74) *Attorney, Agent, or Firm* — Edwards Wildman Palmer LLP; James E. Armstrong, IV; Nicholas J. DiCeglie, Jr.

(57) ABSTRACT

Disclosed herein is a method for separating an arsenic mineral from a copper-bearing material, including the steps of grinding a copper-bearing material containing arsenic, adding water to the copper-bearing material to prepare a slurry, and adding a flotation agent including a depressant, a frother, and a collector to the slurry and blowing air into the slurry for performing flotation to obtain a copper concentrate, wherein the depressant is a chelator. As the chelator, a polyethyleneamine or the like is used. Particularly, when triethylenetetramine is used as the chelator, the amount of triethylenetetramine to be added is preferably 1 to 10 equivalents relative to the amount of soluble copper generated by oxidation of the copper-bearing material, and the pH of the slurry is more preferably adjusted to 7 or more but 8 or less before the slurry is subjected to the flotation.

18 Claims, 1 Drawing Sheet

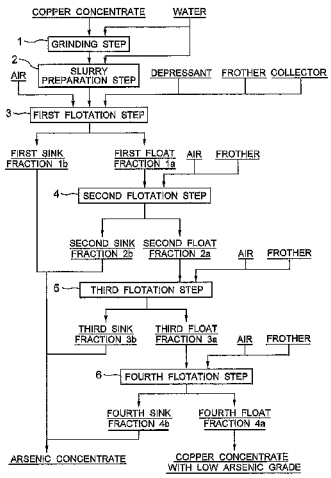

(56) References Cited

U.S. PATENT DOCUMENTS

2008/0152558 A1* 6/2008 Hultholm et al. ..... 423/27
2009/0301972 A1* 12/2009 Hines et al. ..... 210/705

OTHER PUBLICATIONS

International Search Report dated Apr. 19, 2011, issued for PCT/JP2011/052251.

* cited by examiner

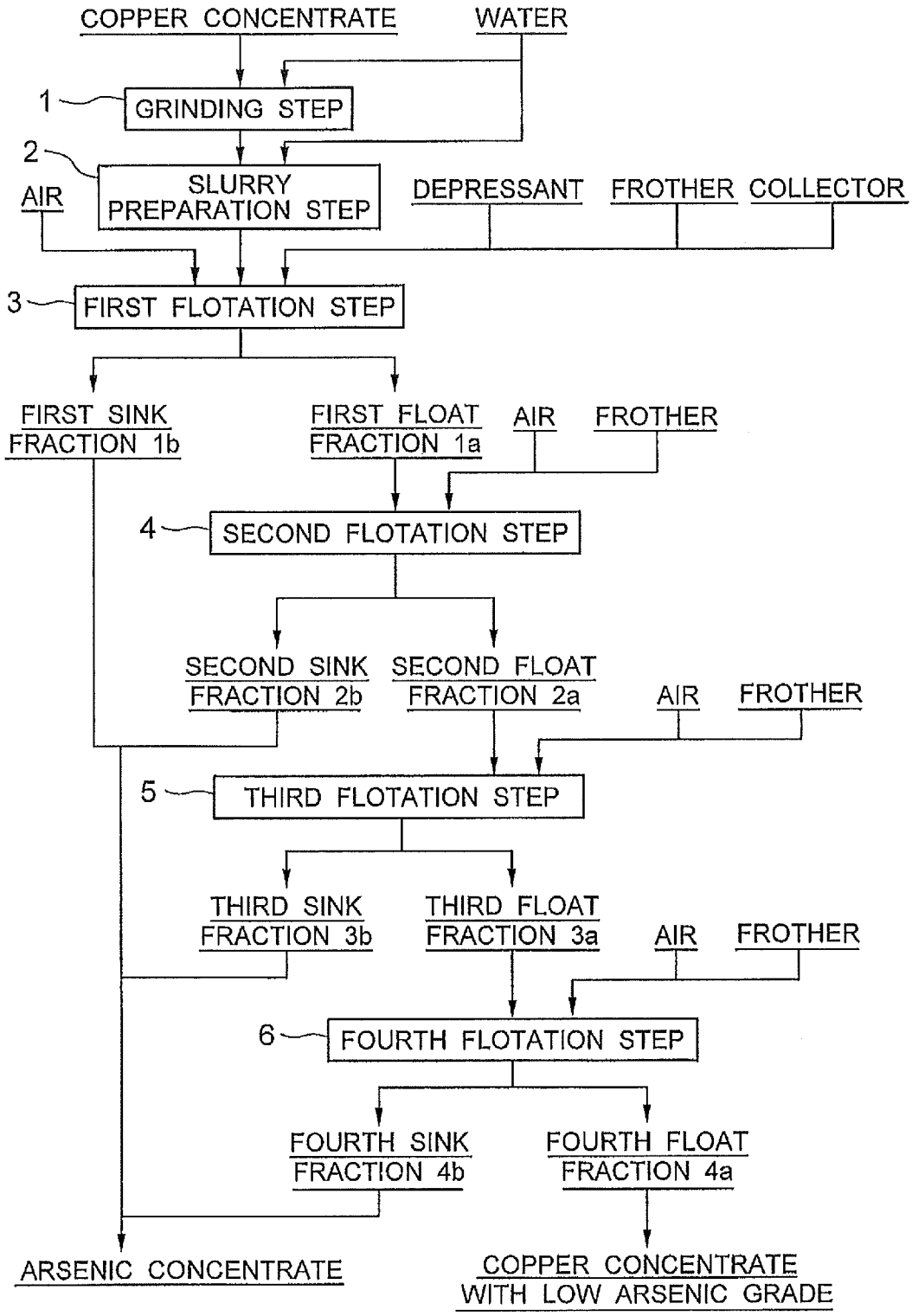
COPPER CONCENTRATE
WATER
1
GRINDING STEP
2
SLURRY PREPARATION STEP
AIR
DEPRESSANT
FROTHER
COLLECTOR
3
FIRST FLOTATION STEP
FIRST SINK FRACTION 1b
FIRST FLOAT FRACTION 1a
AIR
FROTHER
4
SECOND FLOTATION STEP
SECOND SINK FRACTION 2b
SECOND FLOAT FRACTION 2a
AIR
FROTHER
5
THIRD FLOTATION STEP
THIRD SINK FRACTION 3b
THIRD FLOAT FRACTION 3a
AIR
FROTHER
6
FOURTH FLOTATION STEP
FOURTH SINK FRACTION 4b
FOURTH FLOAT FRACTION 4a
ARSENIC CONCENTRATE
COPPER CONCENTRATE WITH LOW ARSENIC GRADE

METHOD FOR SEPARATING ARSENIC MINERAL FROM COPPER-BEARING MATERIAL WITH HIGH ARSENIC GRADE

TECHNICAL FIELD

The present invention relates to a mineral dressing method for obtaining a copper concentrate with low arsenic grade by separating an arsenic mineral from a copper-bearing material containing arsenic.

BACKGROUND ART

In the field of copper smelting, various methods have been proposed to recover copper from a copper-containing processing object (hereinafter, referred to as a "copper-bearing material) such as a copper ore or a copper concentrate. For example, when copper is recovered from a copper sulfide ore as one example of a copper-bearing material, the copper sulfide ore is usually processed through the following steps.

(1) Flotation Step

In the flotation step, a copper ore extracted from amine is ground and then mixed with water to prepare a slurry, and the slurry is subjected to flotation. The flotation is a separation process performed by adding a flotation agent containing a depressant, a frother, and a collector to the slurry and by blowing air into the slurry so that copper-containing minerals float and gangue sinks. As a result, a copper concentrate with a copper grade of about 30% can be obtained. The obtained copper concentrate is sent to the next fire refining step.

(2) Fire Refining Step

In the fire refining step, the copper concentrate obtained in the above flotation step is smelted in a smelter such as a flash smelter, and is then refined in a converter furnace and then in a refining furnace to obtain blister copper with a copper grade of about 99%. The blister copper is cast into anodes, and then the anodes are sent to the next electrolysis step. Arsenic contained in the copper concentrate is distributed to slag, dust, and blister copper by fire refining. The slag is granulated with water and used as a land-fill material or the like. The dust is returned to the furnace. Sulfur contained in the copper concentrate is separated as sulfur dioxide and used as a raw material for sulfuric acid.

(3) Electrolysis Step

In the electrolysis step, the anodes are placed in an electrolysis tank filled with a sulfuric acid acidic solution (electrolyte), and electrolytic refining is performed by applying electric current between the anodes and cathodes. By performing the electrolytic refining, copper contained in the anodes is dissolved and then deposited on the cathodes as electrolytic copper with a purity of 99.99% which is a product. At this time, arsenic that has been distributed to the anodes is eluted into the electrolyte. The eluted arsenic is recovered as decopperized slime by electrolytic copper removal. The decopperized slime is used as an intermediate material or returned to the furnace.

Arsenic distributed to slag in the fire refining step is fixed in a stable form. However, arsenic distributed to dust and decopperized slime is in an unstable form, and therefore it is undesirable to directly discharge the dust and the decopperized slime outside the system for disposal. For this reason, these dust and decopperized slime are returned to the furnace or separately processed. In this way, most of arsenic matter contained in the copper concentrate is finally distributed to slag and fixed in a stable form.

Meanwhile, raw material conditions have been changed in recent years. More specifically, the impurity content, especially arsenic grade, of copper ores tends to increase year by year, and the arsenic grade of copper concentrates obtained from copper ores is also becoming increasingly higher. For example, the arsenic grade of conventional copper concentrates is about 0.1 to 0.2%, but recently, it is not uncommon for copper concentrates to have an arsenic grade exceeding 1%. Therefore, even when the amount of a copper concentrate to be processed is the same as before, there is a case where existing slag treatment equipment for fixing arsenic to slag cannot cope with an increase in the arsenic content of the copper concentrate. Such a problem can be solved by, for example, providing new slag treatment equipment or increasing the capacity of the existing slag treatment equipment, but this requires a significant investment and therefore leads to an increase in cost.

It is considered that if the arsenic grade of a copper concentrate can be reduced to, for example, the same level as before by separating and removing arsenic in the process of obtaining a copper concentrate from a copper ore, the need for making such an investment can be eliminated and the existing slag treatment equipment can be operated without changing its initial arsenic processing load.

In this regard, Patent Document 1 discloses a method for separating arsenopyrite contained in iron pyrite by flotation. In this method, flotation is performed by adding a sulfuric acid-based depressant containing hydrogen sulfite ions, such as sodium hydrogen sulfite, to iron pyrite under conditions where the pH of a slurry is maintained at 8 or less and the temperature of the slurry is set to 30° C. or higher so that arsenopyrite is separated from the iron pyrite.

However, it is difficult to directly apply this method to separation of arsenic from a copper ore or a copper concentrate. This is because, in the case of, for example, a copper concentrate mainly containing chalcopyrite or bornite, arsenic is often present as an arsenic mineral such as tennantite ($(CuFe)_{12}As_4S_{13}$) or enargite ($Cu_3AsS_4$), and these arsenic minerals have floating properties similar to those of chalcopyrite or bornite, and therefore it is difficult to separate arsenic and copper from each other by flotation.

Patent Document 2 discloses a method in which an arsenic-containing copper concentrate is heated at 90 to 120° C., and then potassium hexacyanoferrate (II) (yellow prussiate of potash: $K_4[Fe(CN)_6]$) is added as a depressant for suppressing the flotation of copper in an amount of 10 to 15 kg per ton of the copper concentrate to float an arsenic mineral to separate it from chalcopyrite or bornite that sinks.

This method uses oxidization of a surface of the copper mineral in a copper concentrate by heating, which forms an inactive oxide film on the surface. It is considered that this inactive oxide film causes the difference in surface chemical state or crystal chemical state between the surface of the copper mineral and a surface of an arsenic mineral, which causes difference in floating properties in subsequent flotation process. However, when practically used, this method requires equipment and energy for heating a large amount of copper concentrate, which causes a problem such as an increase in cost.

Patent Document 3 discloses a method for suppressing the flotation of an arsenic mineral in which a non-ferrous metal sulfide mineral containing arsenic is subjected to flotation at a pH of 9 to 10 by adding air, hydrogen peroxide, another oxidizer, xanthate as a collector, and a mixture of a polyamine and a sulfur compound as a depressant. This method mainly describes a method for separation between a nickel sulfide mineral and an arsenic mineral, but does not describe separation between a copper mineral and an arsenic mineral.

Non-Patent Document 1 discloses a method for performing flotation in which a copper mineral-containing slurry is treated with hydrogen peroxide, and then the pH of the slurry is adjusted to 5 by adding sodium nitrate. This non-Patent Document also proposes a method for performing flotation in which hydrogen peroxide and EDTA are added to a copper mineral and then pH is adjusted to 11 with potassium hydroxide. However, these two methods have problems in cost and safety during handling of deleterious substances.

As described above, it is difficult for any of the above methods to efficiently separate an arsenic mineral from a copper-bearing material by flotation.

CITATION LIST

Patent Document

Patent Document 1: U.S. Pat. No. 5,171,428
Patent Document 2: JP-A No. 2006-239553
Patent Document 3: U.S. Pat. No. 7,004,326

Non Patent Document

Non-Patent Document 1: D. Formasiero, D. Fullston, C. Li and J. Ralston: Mineral Processing, 61 (2001), 109-119

SUMMARY OF INVENTION

Technical Problem

In view of the above problems associated with the conventional art, it is an object of the present invention to provide a mineral dressing method for efficiently separating an arsenic mineral from a copper-bearing material containing arsenic.

Solution to Problem

To solve the above problem, a method for separating an arsenic mineral from a copper-bearing material provided by the present invention comprises the steps of grinding a copper-bearing material containing arsenic, adding water to the copper-bearing material to prepare a slurry, and adding a flotation agent including a depressant, a frother, and a collector to the slurry and blowing air into the slurry for performing flotation to obtain a copper concentrate, wherein the depressant is a chelator.

In the separation method according to the present invention, at least one of polyethyleneamines such as triethylenetetramine and pentaethylenehexamine, ethylenediaminetetraacetic acid, and cyclohexanediaminetetraacetic acid is preferably used as the chelator. When triethylenetetramine is used as the chelator, the amount of triethylenetetramine to be added is preferably 1 to 10 equivalents relative to the amount of soluble copper generated by oxidation of the copper-bearing material, and further, the pH of the slurry is more preferably adjusted to 7 or more but 8 or less before the slurry is subjected to the flotation. In the separation method according to the present invention, the copper-bearing material may be a copper ore or a copper concentrate.

Advantageous Effects of Invention

According to the present invention, it is possible to separate an arsenic mineral from a copper-bearing material with high arsenic grade without using special equipment and hazardous chemicals to obtain an arsenic concentrate and a copper concentrate with low arsenic grade. By using the thus obtained copper concentrate with low arsenic grade to produce refined copper, it is possible to suppress the impact of arsenic on environment in the process of refining, and to suppress a capital expenditure caused by an increase in arsenic processing load. Further, the present invention makes it possible to separate an arsenic mineral and recover it as an arsenic concentrate, which improves the productivity of metallic arsenic or an arsenic compound.

BRIEF DESCRIPTION OF DRAWINGS

FIG. 1 is a schematic flow diagram of a mineral dressing method used in examples of the present invention.

DESCRIPTION OF EMBODIMENTS

The arsenic grade of a copper-bearing material with high arsenic grade to be processed according to the present invention and the kind of arsenic mineral contained in the copper-bearing material with high arsenic grade are not particularly limited. However, the arsenic mineral needs to be present as free particles in order to effectively perform flotation, and therefore pretreatment such as grinding is preferably performed so that most of the arsenic mineral is separated as free particles. When proper separation is not achieved due to tight binding between an arsenic mineral and a copper mineral contained in a copper-bearing material, the copper-bearing material is ground by, for example, a wet ball mill, before the copper-bearing material is processed according to the present invention.

Hereinbelow, with reference to a case where the copper-bearing material is a copper ore, a method for recovering a copper concentrate with low arsenic grade will be described in detail where an arsenic mineral and gangue are separated from a copper ore with high arsenic grade. However, the present invention is not limited to this example, and the copper-bearing material may be a copper concentrate. That is, the present invention can be also applied to a case where an arsenic mineral is separated from a copper concentrate with high arsenic grade, which is obtained by a conventional flotation method, so as to recover a copper concentrate with low arsenic grade. In this case, the copper grade of the copper concentrate with high arsenic grade to be used as a raw material is not particularly limited.

As described above, when the copper-bearing material is a copper ore with high arsenic grade, the copper ore is subjected to grinding as pretreatment, and then mixed with water to obtain a slurry. Then, a flotation agent containing a frother, a collector, and a depressant is added to the obtained slurry to perform flotation. As the depressant, a chelator that forms a chelate with copper is used. This makes it possible to float and separate a copper concentrate with low arsenic grade mainly containing chalcopyrite or bornite while allowing an arsenic mineral contained in the copper-bearing material with high arsenic grade to sink as an arsenic concentrate together with gangue.

As the chelator, one that forms a chelate with copper can be used. Examples of such a chelator include commonly-produced chelators such as polyethyleneamines (e.g., triethylenetetramine and pentaethylenehexamine), ethylenediaminetetraacetic acid, and cyclohexanediaminetetraacetic acid. The form of the chelator is not particularly limited, and the chelator may be added either as a powder or as a solution.

Such a chelator forms a chelate with soluble copper, such as copper sulfate, generated by oxidation of the copper concentrate. An arsenic mineral such as tennantite is known as an impurity less likely to be separated from a copper sulfide mineral such as chalcopyrite. The present inventors have intensively studied why an arsenic mineral floats together with a copper sulfide mineral by flotation, and as a result have found that copper ions generated by oxidation of the copper mineral are adsorbed to the arsenic mineral, and a collector is bound to the arsenic mineral via the copper ions so that the arsenic mineral as well as the copper mineral floats.

It is considered that the activity of the copper ions can be suppressed by increasing the pH of the slurry. However, actual flotation involves a grinding process, and therefore there is a case where the arsenic mineral is activated even when flotation is performed at a high pH at which the copper ions are precipitated. The chelator used in the present invention has the function of stabilizing the copper ions in the liquid by chelation to inhibit adsorption of the copper ions to the arsenic mineral.

The chelator has a certain level of arsenic mineral suppressing effect as long as its chelate formation constant with copper ions is high. Particularly, the use of a chelator having high copper ion selectivity, such as triethylenetetramine, is highly effective. When a chelator having no selectivity is used, a hydrophilic coating of iron oxide or the like formed on the surface of the arsenic mineral is also removed by the chelator and therefore the hydrophobicity of the arsenic mineral is increased, which makes it difficult to separate the arsenic mineral from the copper mineral.

The chelate formation constant of a polyethyleneamine-based chelator, such as triethylenetetramine, with copper ions changes depending on pH. When pH is higher, the dissociation degree of amine groups is lower and the chelate formation constant with copper is higher, which would enhance an effect to remove copper ions from the arsenic mineral. However, when pH is higher, triethylenetetramine is more likely to become oily, which more adversely affects (i.e., reduces) selectivity in flotation. The present inventors have repeatedly performed experiments under various conditions, and as a result have found that, when triethylenetetramine is used, the best separation performance is achieved when the pH of the slurry is in the range of 7 or more but 8 or less.

Based on the above principles, the amount of the chelator that needs to be added to stabilize copper ions in the liquid (hereinafter, also referred to as a "chelator requirement") is 1 equivalent or more relative to the amount of soluble copper present in the slurry. However, as a result of researches conducted by the present inventors, it has been found that the best results are obtained by adding triethylenetetramine in an amount of about 8 equivalents relative to the amount of soluble copper. The effects of the present invention can be obtained even when 10 or more equivalents of triethylenetetramine is added. However, this leads to wasteful consumption of the reagent, and when pH is high, this adversely affects (i.e., degrades) separation performance because triethylenetetramine becomes oily.

Some chelators such as triethylenetetramine function as surfactants per se. Therefore, there is a case where addition of such a chelator to a flotation slurry leads to excessive frothing. This occurs to some extent even when the pH of the slurry is within the appropriate range described above, and has a greater influence as the amount of the chelator added increases. Usually, increase of the amount of the slurry that flows out together with bubbles due to excessive frothing increases entrainment of an unwanted component, which does not adhere to bubbles under normal conditions, into froth. This phenomenon leads to degradation of separation performance.

In order to prevent such degradation in separation performance caused by the above reason, addition of the chelator in two steps in flotation is effective. More specifically, one-half or more of a chelator requirement is first added to perform the above-described flotation for separation so that a slurry of float fraction and a sink fraction are separated. Then, the obtained slurry of float fraction is separated by solid-liquid separation (e.g., filtration) into solid matter and filtrate. The solid matter is recovered and repulped by mixing with water containing no chelator to obtain a slurry. The amount of water to be added is not particularly limited, but is preferably almost the same as that of the filtrate. Then, the remainder of the chelator requirement is added to the slurry obtained by repulping to perform flotation again. It is to be noted that the total chelator requirement may be added when the chelator is added for the first time. In this case, the chelator is not added in the second flotation.

In examples that will be described later, methyl isobutyl carbinol and AP208 manufactured by Cytec Industries Inc. are used as the frother and the collector contained in the flotation agent, respectively. However, the frother and the collector contained in the flotation agent are not limited thereto, and other conventional frother and collector may be used. The specific amounts of the frother and the collector to be added may be determined by performing a pretest using a small amount of sample in advance or may be appropriately adjusted during actual operation so that proper separation can be achieved.

A flotation machine to be used in the present invention is not particularly limited, and for example, a commercially-available mechanical agitation-type flotation machine or column-type flotation machine may be used. Appropriate flotation time varies depending on the arsenic mineral content of a copper ore or a copper concentrate used as a copper-bearing material with high arsenic grade or a target degree of separation. Therefore, as in the above-described case of determining the amounts of the frother and the collector to be added, it is preferred that the flotation time is determined by performing a pretest or appropriately adjusted during actual operation.

According to the above-described method, the arsenic mineral contained in the copper-bearing material with high arsenic grade can be separated as a sink fraction and the copper concentrate with low arsenic grade can be separated as a float fraction. As described above, the arsenic concentrate and the copper concentrate with low arsenic grade can be obtained in the process of flotation, and therefore even when the arsenic content of the copper-bearing material increases, electrolytic copper as a product can be obtained in the same manner as before. This eliminates the need for making a significant investment in, for example, increasing the capacity of existing equipment for removing and recovering arsenic such as slag treatment equipment in the process of fire refining or electrolytic copper removal equipment. Further, the arsenic concentrate may be separately processed to recover not only arsenic but also copper distributed to the arsenic concentrate. The recovered arsenic can be used as a raw material for metallic arsenic or an arsenic compound.

EXAMPLES

The present invention will be described in more detail with reference to the following examples and comparative examples. However, the present invention is not limited to these examples. For example, in the following examples, a copper-bearing material is processed through four flotation steps, but the number of flotation steps is not limited thereto, and is appropriately determined depending on the properties of a copper-bearing material to be processed, cost effectiveness, etc. It is to be noted that in the following examples and comparative examples, chemical analytical values were determined by ICP emission spectrometry and the mineral composition of a copper-bearing material to be processed was determined by observation with a microscope. As a copper-bearing material, a copper concentrate of Peru origin was used. The chemical analytical values and mineral composition of the copper concentrate are shown in the following Table 1.

TABLE 1

| Chemical Analytical Value (wt %) | | Mineral Composition (wt %) | | |
|---|---|---|---|---|
| Cu | As | Chalcopyrite | Chalcocite | Tennantite |
| 24.8 | 0.27 | 59.6 | 4.3 | 1.4 |

Examples 1 to 4

In Example 1, the copper concentrate of Peru origin shown in the above Table 1 was subjected to flotation according to a flow diagram shown in FIG. 1 to obtain a copper concentrate with low arsenic grade and an arsenic concentrate. More specifically, 100 g of the copper concentrate of Peru origin (sample A) shown in the above Table 1 was mixed with 100 ml of water and ground by a ball mill so that an 80%-pass particle size of 25 μm was achieved (grinding step 1). The thus obtained ground product was mixed with water to prepare a slurry having a total weight of 500 g and a volume of 400 ml (slurry preparation step 2). This slurry was charged into an Agitair type flotation test machine having a cell volume of 0.5 L, and then agitation was started.

Then, TETA (triethylenetetramine) was added as a depressant for suppressing the flotation of an arsenic mineral in an amount of 0.24 g corresponding to 2.4 kg per ton of the copper concentrate. The amount of the depressant added was determined by a pretest in the following manner. TETA was added stepwise to a slurry having the same concentration and weight, and the maximum concentration of Cu in the liquid was determined and defined as a maximum soluble copper concentration (in the case of the sample A, 255 ppm). The amount of TETA to be added was determined from the amount of TETA such that the concentration of TETA was 1 equivalent relative to the copper concentration. After the addition of TETA, the slurry was agitated for 8 minutes to promote reaction with Cu contained in the liquid.

Then, AP208 (trade name) manufactured by Cytec Industries Inc., USA was added as a collector in an amount of 0.0075 g corresponding to 75 g per ton of the copper concentrate. Further, MIBC (methyl isobutyl carbinol) was added as a frother in an amount of 0.0090 g corresponding to 90 g per ton of the copper concentrate. The amounts of the collector and the frother added were determined from their respective amounts that yielded the best results in a pretest. After the collector and the frother were added, the pH of the slurry was measured while the slurry was agitated for 2 minutes.

Then, flotation was performed for 8 minutes for separation by blowing air into the slurry at a flow rate of 2 L/min with agitation to obtain a first float fraction 1*a* and a first sink fraction 1*b* (first flotation step 3). The obtained first float fraction 1*a* was sent to a floatation test machine for a second flotation step and mixed with water so that its volume was almost the same as that of the slurry prepared in the slurry preparation step 2. To the slurry of the first float fraction 1*a*, the frother was added in an amount of 0.0020 g corresponding to 20 g per ton of the copper concentrate. The collector and the depressant were not added. Then, flotation was performed for 5 minutes by blowing air into the slurry of the first float fraction 1*a* at a flow rate of 2 L/min to obtain a second float fraction 2*a* and a second sink fraction 2*b* (second flotation step 4).

As shown in FIG. 1, flotation was further repeated two times in the same manner as in the second flotation step 4 to obtain a third sink fraction 3*b*, a fourth sink fraction 4*b*, and a fourth float fraction 4*a* (third flotation step 5 and fourth flotation step 6). The first to fourth sink fractions 1*b* to 4*b* were mixed to obtain an arsenic concentrate, and the fourth float fraction 4*a* was defined as a copper concentrate with low arsenic grade. The thus obtained arsenic concentrate and copper concentrate with low arsenic grade were analyzed to determine the distribution ratios of Cu and As.

In each of Examples 2 to 4, an arsenic concentrate and a copper concentrate with low arsenic grade were obtained in the same manner as in Example 1 except that the amount of TETA added was changed to 2 to 8 equivalents. Further, sulfuric acid was added to the slurry after addition of TETA to adjust the pH of the slurry to about 5.8 that was nearly equal to that in Example 1. This is because the pH of the slurry increases as the amount of basic TETA added increases.

Examples 5 to 9

In Examples 5 to 7, flotation was performed in the same manner as in Example 1 except that the chelator was changed from TETA to EDTA (ethylenediaminetetraacetic acid) and the amount of the chelator added was changed to 5 to 20 equivalents. In Examples 8 and 9, flotation was performed in the same manner as in Example 1 except that the chelator was changed from TETA to 8 equivalents of PEHA (pentaethylenehexamine) or CyDTA (cyclohexanediaminetetraacetic acid) and the pH of the slurry was adjusted to about 5.8 with sulfuric acid.

Comparative Example 1

Flotation was performed in the same manner as in Example 1 except that no chelator was added.

Examples 10 to 16

A sample B (obtained by allowing the copper concentrate of Peru origin shown in Table 1 to stand in air for 30 days to promote oxidation of copper minerals) was used. The maximum amount of copper eluted from the sample was determined in advance in the same manner as in the case of the sample A and was found to be 490 ppm. In Example 10, flotation was performed in the same manner as in Example 1 except that TETA was added so that the concentration of TETA was 2 equivalents relative to the maximum copper concentration and that the pH of the slurry was adjusted to 6.0 with sulfuric acid after addition of TETA. In Examples 11 to 13, flotation was performed in the same manner as in Example 10 except that the pH of the slurry was adjusted to 7.0, 8.0, or 9.0, respectively with sulfuric acid after addition of TETA. In Examples 14 to 16, flotation was performed in the same manner as in Example 11 except that the amount of TETA added was changed to 1, 4, or 11 equivalents, respectively.

Comparative Example 2

Flotation was performed in the same manner as in Example 10 except that no chelator was added.

Reference Examples 1 to 3

In Reference Example 1, flotation was performed in the same manner as in Example 10 except that the amount of TETA added was changed to 0.2 equivalent. In Reference Examples 2 and 3, flotation was performed in the same manner as in Example 10 except that the amount of TETA added was changed to 20 or 50 equivalents, respectively and that pH adjustment with sulfuric acid was omitted.

Example 17

The grinding step 1, the slurry preparation step 2, and the first flotation step 3 were performed in the same manner as in Example 11 except that the amount of TETA added was changed from 2 equivalents to 1 equivalent to obtain a slurry of float fraction. Then, the slurry of float fraction was filtered through a Nutsche filter with filter paper to recover solid matter. The recovered solid matter was repulped by mixing with the same amount of fresh water as filtrate to obtain a slurry, and 1 equivalent of TETA was further added to the slurry. The slurry was again charged into the Agitair type flotation test machine and subjected to flotation again under the same conditions as in the first flotation step 3 to obtain a float fraction. This float fraction was defined as a first float fraction 1*a*, and the subsequent steps were performed in the same manner as in Example 11. It is to be noted that a sink fraction obtained in the first flotation step 3 performed for the first time and a sink fraction obtained in the first flotation step 3 performed again were mixed to obtain a first sink fraction 1*b*.

The first float fractions 1*a* and the copper concentrates with low arsenic grade obtained in the above Examples, Comparative Examples, and Reference Examples were analyzed to determine their copper recovery and degree of separation between copper and arsenic. The degree of separation between copper and arsenic was evaluated based on the degree of separation determined by the following formula 1.

DEGREE OF SEPARATION = [Formula 1]

COPPER DISTRIBUTION RATIO TO FLOAT FRACTION 100 – COPPER DISTRIBUTION RATIO TO FLOAT FRACTION ARSENIC DISTRIBUTION RATIO TO FLOAT FRACTION 100 – ARSENIC DISTRIBUTION RATIO TO FLOAT FRACTION

The degree of separation represented by the above formula 1 is higher when the copper distribution ratio to float fraction is higher and the arsenic distribution ratio to float fraction is lower. That is, a higher degree of separation indicates that a more favorable result that fulfills the purpose of the present invention has been obtained.

The thus obtained values of the copper recovery and the degree of separation of the first float fractions 1*a* and the copper concentrates with low arsenic grade of Examples, Comparative Examples, and Reference Examples are shown in the following Table 2 together with major floatation conditions.

TABLE 2

| | | Chelator | | | | 1st. Float Fraction 1a | | Cu Conc. with Low As Grade | |
|---|---|---|---|---|---|---|---|---|---|
| | Sample | Type | Amount added (kg/t) | No. of Equiv. Added | Flotation pH | Cu Recovery (%) | Degree of Separation | Cu Recovery (%) | Degree of Separation |
| Example 1 | A | TETA | 2.4 | 1 | 5.8 | 94.3 | 3.7 | 64.7 | 8.5 |
| Example 2 | A | TETA | 4.7 | 2 | 5.7 | 93.5 | 5.9 | 67.9 | 11.9 |
| Example 3 | A | TETA | 9.4 | 4 | 5.6 | 95.1 | 6.9 | 72.1 | 16.9 |
| Example 4 | A | TETA | 18.8 | 8 | 5.7 | 94.6 | 7.7 | 73.8 | 19.7 |
| Example 5 | A | EDTA | 12.0 | 5 | 5.5 | 90.7 | 3.7 | 67.7 | 9.2 |
| Example 6 | A | EDTA | 24.0 | 10 | 6.6 | 88.6 | 5.7 | 61.2 | 24.8 |
| Example 7 | A | EDTA | 48.0 | 20 | 5.7 | 91.3 | 5.3 | 67.2 | 24.5 |
| Example 8 | A | PEHA | 29.8 | 8 | 5.7 | 92.3 | 6.9 | 75.2 | 14.4 |
| Example 9 | A | CyDTA | 46.8 | 8 | 6.0 | 80.1 | 5.7 | 48.7 | 47.8 |
| Comparative Example 1 | A | None | — | — | 5.7 | 96.5 | 2.4 | 77.6 | 3.7 |
| Example 10 | B | TETA | 10.0 | 2 | 6.0 | 98.7 | 3.7 | 75.8 | 5.7 |
| Example 11 | B | TETA | 10.0 | 2 | 7.0 | 97.0 | 4.7 | 68.7 | 8.1 |
| Example 12 | B | TETA | 10.0 | 2 | 8.0 | 95.6 | 4.8 | 65.3 | 6.8 |
| Example 13 | B | TETA | 10.0 | 2 | 9.0 | 95.1 | 4.3 | 59.6 | 5.7 |
| Example 14 | B | TETA | 5.0 | 1 | 7.0 | 97.5 | 4.2 | 77.9 | 5.6 |
| Example 15 | B | TETA | 20.0 | 4 | 6.9 | 96.4 | 3.7 | 77.0 | 4.5 |
| Example 16 | B | TETA | 50.0 | 11 | 7.0 | 96.2 | 3.7 | 75.4 | 4.4 |
| Comparative Example 2 | B | None | — | — | 4.4 | 98.1 | 2.0 | 84.6 | 1.9 |
| Reference Example 1 | B | TETA | 1.0 | 0.2 | 4.5 | 97.7 | 2.0 | 77.8 | 1.9 |
| Reference Example 2 | B | TETA | 20.0 | 4 | 10.0 | 97.2 | 1.9 | 80.6 | 2.2 |
| Reference Example 3 | B | TETA | 50.0 | 11 | 10.7 | 94.0 | 1.6 | 76.7 | 1.8 |
| Example 17 | B | TETA | 10.0 | 2 | 7.0 | 94.3 | 3.8 | 60.7 | 9.8 |

As can be seen from the above Table 2, the copper recovery and the degree of separation of the first float fraction 1*a* of Example 1 were 94.3% and 3.7, respectively, and the copper recovery and the degree of separation of the copper concentrate with low arsenic grade of Example 1 were 64.7% and 8.5, respectively. Further, as can be seen from the results of Examples 1 to 4, the degree of separation increases as the amount of TETA added increases. More specifically, when 8 equivalents of TETA was added (Example 4), the degree of separation of the first float fraction 1*a* was 7.7 and the degree of separation of the copper concentrate with low arsenic grade was 19.7.

When 5 equivalents of EDTA was added in Example 5, the degree of separation of the first float fraction 1*a* was 3.7 and the degree of separation of the copper concentrate with low arsenic grade was 9.2, which were almost the same results as when 1 equivalent of TETA was added in Example 1. When the amount of EDTA added was increased to 10 equivalents in Example 6, the degree of separation of the first float fraction 1*a* was 5.7 and the degree of separation of the copper concentrate with low arsenic grade was 24.8, but the copper recovery of the copper concentrate with low arsenic grade was 61.2%, which was lower than those when TETA was used. As can be seen from the results of Example 7, even when EDTA was added in an amount of 20 equivalents, the degree of separation of the first float fraction 1*a* was 5.3 and the degree of separation of the copper concentrate with low arsenic grade was 24.5, that is, the degree of separation was not improved.

In Example 8 using PEHA, the degree of separation of the first float fraction 1*a* was 6.9 and the degree of separation of the copper concentrate with low arsenic grade was 14.4, which were slightly lower than those when the same equivalents of TETA was added in Example 4. CyDTA is a chelator having a higher ability to form a complex than TETA. Therefore, in Example 9 using CyDTA, the degree of separation of the first float fraction 1*a* was as high as 5.7 and the degree of separation of the copper concentrate with low arsenic grade was as high as 47.8. However, the flotation of part of the copper minerals was also suppressed, and therefore the copper recovery of the copper concentrate with low arsenic grade was as low as 48.7%.

On the other hand, in Comparative Example 1, the degree of separation of the first float fraction 1*a* was 2.4 and the degree of separation of the copper concentrate with low arsenic grade was 3.7, which were much lower than those of Examples 1 to 9. This is because, due to the absence of a chelator, the arsenic mineral was activated by copper ions liberated from the copper minerals and the like and therefore floated.

In Example 10, the degree of separation of the first float fraction 1*a* was 3.7 and the degree of separation of the copper concentrate with low arsenic grade was 5.7. As can be seen from the results of Examples 11 to 13, the degree of separation of the copper concentrate with low arsenic grade was maximum (i.e., 8.1) when the pH was 7.0, but decreased as the pH increased. Further, as can be seen from the results of Example 11 and Examples 14 to 16, when the pH was the same, the degree of separation was maximum when the amount of TETA added was 2 equivalents (Example 11), but was not improved any further even when the amount of TETA added was increased to 4 or more equivalents.

As can be seen from the results of Comparative Example 2, the natural pH of the slurry was as low as 4.4 due to the oxidation of the copper concentrate. The degree of separation of the first float fraction 1*a* was 2.0 and the degree of separation of the copper concentrate with low arsenic grade was 1.9, which were much lower than those of Examples 1 to 16 and Comparative Example 1. This is because the arsenic mineral was significantly activated by Cu ions generated by oxidation of the copper concentrate.

In Reference Example 1, the amount of TETA added was not enough to sufficiently suppress the activation of the arsenic mineral by Cu ions contained in the liquid, and therefore the degree of separation was not improved. In Reference Examples 2 and 3, pH adjustment with sulfuric acid was not performed and therefore the pH was increased to 10 or higher by adding TETA, and TETA added in a large amount became oily and lost its selectivity. Therefore, the degree of separation was not improved.

In Example 17, the amount of an unwanted component contained in the froth layer was reduced due to a decrease in the concentration of TETA in the flotation liquid. Therefore, as compared to Example 11 in which the amount of the reagent added and the flotation pH were the same as those of Example 17, the degree of separation of the copper concentrate with low arsenic grade was improved from 8.1 to 9.8.

REFERENCE SIGNS LIST

1 Grinding Step
2 Slurry Preparation Step
3 First Flotation Step
4 Second Flotation Step
5 Third Flotation Step
6 Fourth Flotation Step

The invention claimed is:

1. A method for separating an arsenic mineral from a copper-bearing material, comprising the steps of grinding a copper-bearing material containing arsenic, adding water to the copper-bearing material to prepare a slurry, and adding a flotation agent including a depressant, a frother, and a collector to the slurry and blowing air into the slurry for performing flotation to obtain a copper concentrate, wherein the depressant is a chelator, wherein a pH of the slurry is adjusted to 5.5 or more but 8 or less before the slurry is subjected to the flotation.

2. The method for separating an arsenic mineral from a copper-bearing material according to claim 1, wherein the chelator is at least one of polyethyleneamines, ethylenediaminetetraacetic acid, and cyclohexanediaminetetraacetic acid.

3. The method for separating an arsenic mineral from a copper-bearing material according to claim 1, wherein the chelator is triethylenetetramine and is added in an amount of 1 to 10 equivalents relative to an amount of soluble copper generated by oxidation of the copper-bearing material.

4. The method for separating an arsenic mineral from a copper-bearing material according to claim 3, wherein a pH of the slurry is adjusted to 7 or more but 8 or less before the slurry is subjected to the flotation.

5. The method for separating an arsenic mineral from a copper-bearing material according to claim 1, wherein flotation is performed to obtain a float fraction by adding one-half or more of an amount of the chelator that needs to be added to stabilize copper ions in the liquid, which is 1 equivalent or more relative to the amount of soluble copper present in the slurry, the obtained float fraction is subjected to solid-liquid separation to recover solid matter, the solid matter is repulped with water containing no chelator to obtain a slurry having a predetermined concentration, and flotation is again performed by adding the remaining chelator to the slurry.

6. The method for separating an arsenic mineral from a copper-bearing material according to claim 1, wherein the copper-bearing material is a copper ore.

7. The method for separating an arsenic mineral from a copper-bearing material according to claim 1, wherein the copper-bearing material is a copper concentrate.

8. The method for separating an arsenic mineral from a copper-bearing material according to claim 2, wherein the copper-bearing material is a copper ore.

9. The method for separating an arsenic mineral from a copper-bearing material according to claim 3, wherein the copper-bearing material is a copper ore.

10. The method for separating an arsenic mineral from a copper-bearing material according to claim 4, wherein the copper-bearing material is a copper ore.

11. The method for separating an arsenic mineral from a copper-bearing material according to claim 5, wherein the copper-bearing material is a copper ore.

12. The method for separating an arsenic mineral from a copper-bearing material according to claim 2, wherein the copper-bearing material is a copper concentrate.

13. The method for separating an arsenic mineral from a copper-bearing material according to claim 3, wherein the copper-bearing material is a copper concentrate.

14. The method for separating an arsenic mineral from a copper-bearing material according to claim 4, wherein the copper-bearing material is a copper concentrate.

15. The method for separating an arsenic mineral from a copper-bearing material according to claim 5, wherein the copper-bearing material is a copper concentrate.

16. The method for separating an arsenic mineral from a copper-bearing material according to claim 1, wherein the chelator is at least one of ethylenediaminetetraacetic acid, pentaethylenehexamine, and cyclohexanediaminetetraacetic acid and a pH of the slurry is adjusted to 5.5 or more but 6.6 or less before the slurry is subjected to the flotation.

17. The method for separating an arsenic mineral from a copper-bearing material according to claim 16, wherein the copper-bearing material is a copper ore.

18. The method for separating an arsenic mineral from a copper-bearing material according to claim 16, wherein the copper-bearing material is a copper concentrate.

* * * * *